US007926198B2

(12) United States Patent
Merritt

(10) Patent No.: US 7,926,198 B2
(45) Date of Patent: Apr. 19, 2011

(54) THERMOELECTRIC HANDHELD DRYER

(75) Inventor: Thomas Merritt, Hollywood, FL (US)

(73) Assignee: Pet Projects, Miami, FL (US)

( * ) Notice: Subject to any disclaimer, the term of this patent is extended or adjusted under 35 U.S.C. 154(b) by 369 days.

(21) Appl. No.: 12/129,262

(22) Filed: May 29, 2008

(65) Prior Publication Data

US 2009/0293300 A1 Dec. 3, 2009

(51) Int. Cl.
*A45D 20/10* (2006.01)
*H05B 3/00* (2006.01)

(52) U.S. Cl. ..... 34/96; 34/97; 34/283

(58) Field of Classification Search ..... 34/96, 97, 34/283; 392/379–385
See application file for complete search history.

(56) References Cited

U.S. PATENT DOCUMENTS 4,635,382 A * 1/1987 Bourdeau ..... 34/97
5,507,103 A 4/1996 Merritt
6,122,185 A * 9/2000 Utsunomiya et al. ..... 363/60
6,422,307 B1 * 7/2002 Bhatti et al. ..... 165/185
6,525,934 B1 * 2/2003 Nakanishi et al. ..... 361/679.47

FOREIGN PATENT DOCUMENTS

JP 06335407 A * 12/1994
WO 2005102101 A1 11/2005

OTHER PUBLICATIONS

International Search Report and written opinion dated Jan. 27, 2010.

* cited by examiner

*Primary Examiner* — Jiping Lu
(74) *Attorney, Agent, or Firm* — Laurence A. Greenberg; Werner H. Stemer; Ralph E. Locher

(57) ABSTRACT

A handheld dryer having low power consumption is provided. A fan operates to cause air to be drawn into the housing of the dryer, creating an airstream of substantial velocity that is forced through a heater assembly. The heater assembly includes two Peltier thermoelectric modules in thermal communication with a plurality of heat sinks. The airstream generated by the fan passes through the heat sinks to remove the heat therefrom, and is, in turn, heated. The passage of the airstream through the dryer housing results in each thermoelectric module operating at essentially a zero temperature differential between its hot and cold face. Resultantly, hot air is discharged from the handheld dryer, which can be used to dry hair or other objects.

29 Claims, 12 Drawing Sheets

THERMOELECTRIC HANDHELD DRYER

BACKGROUND OF THE INVENTION

1. Field of the Invention

The invention relates to an improved handheld device for drying hair or the like, and more particularly, to an improved hair dryer having a low power consumption.

2. Description of the Related Art

U.S. Pat. No. 5,507,103 (the "'103 patent") to the current applicant discloses a thermoelectric hair dryer apparatus capable of low power consumption which makes use of a single thermoelectric cooling and heating module, that patent being incorporated herein, in its entirety, by reference. The hair dryer of the '103 patent includes a motor driven fan which forces ambient air across each opposite face of the thermoelectric module simultaneously and at a high velocity. In the '103 patent, the thermoelectric module behaves as a heat pump by absorbing heat through a first heat sink in contact with one side of the module, pumping the heat through the module with a low voltage DC electric current, and rejecting the heat through a second heat sink in contact with the second side of the module. More particularly, the '103 patent discloses associating the thermoelectric module with upper and lower heat transfer elements, thereby forming an assembly, which is located within a conduit so as to divide or split the airstream created by a fan. In the '103 patent, the splitting of the airstream causes a first portion of the air to flow across the hot face of the module, and a second portion of the air to flow over the cold face of the module, and by virtue of the second portion of the air flowing across the cold face of the module, a quantity of heat is removed from the second portion. An adjustable air damper located at the output of the dryer of the '103 patent is positioned within the exiting airstream so as to affect the direction of air flowing past the module, thereby allowing more or less of either hot or ambient air to predominate the mixture.

The '103 patent additionally discloses that, operating at the DT=0 condition, a Peltier effect thermoelectric module is capable of its highest heat pumping performance. When the heat created by the power input itself (Joules heat) is accounted for, the module is capable of producing a higher quantity of heat than it would under normal conditions (that is to say, when operating at a given temperature difference other than zero). For example, a module which has the capability of pumping 62 watts of heat from the cold face, with input power of 120 watts, would actually be pumping 182 watts of heat. Stated as a formula: $Q_{max}=P_{in}+Q_c$. It may be appreciated that the total amount of heat produced by this arrangement amounts to the sum, which is also substantially higher than would normally be produced by the input power (120 watts) alone (i.e., the total heat ejected by the module is the sum of the current times the voltage plus the heat being pumped through the cold side).

What is needed is a handheld dryer that even more efficiently utilizes a Peltier effect thermoelectric module.

SUMMARY OF THE INVENTION

It is accordingly an object of the present invention to provide a handheld dryer utilizing Peltier thermoelectric heating modules, and having a low consumption of power. Accordingly, it is an object of the present invention to provide a handheld dryer using a thermoelectric module operating at substantially a zero temperature differential between its hot and cold faces. In one particular embodiment of the present invention, two thermoelectric heating modules are used.

Other features which are considered as characteristic for the invention are set forth in the appended claims.

Although the invention is illustrated and described herein as embodied in a thermoelectric handheld dryer, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

The present invention is illustrated by way of example, and not by way of limitation, in the figures of the accompanying drawings, in which like reference numerals refer to similar elements and in which.

DESCRIPTION OF THE PREFERRED EMBODIMENTS

Figure 1:
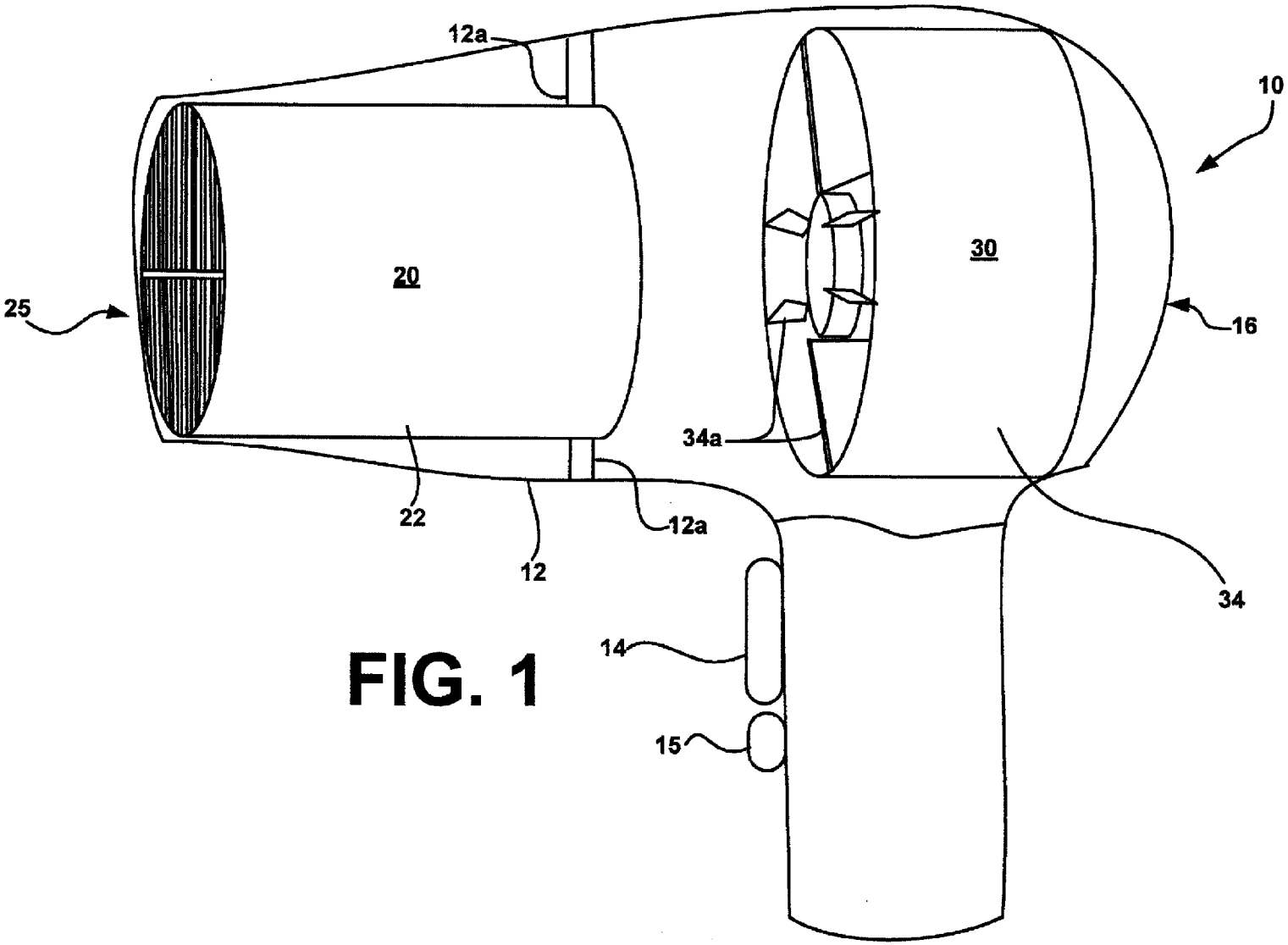
FIG. 1 is a perspective partial cutaway view of a low power hair dryer in accordance with one particular embodiment of the present invention.

Referring now to FIG. 1, there is shown a low power hair dryer or blow dryer 10, in accordance with one particular embodiment of the present invention. The dryer 10 is designed to be handheld and includes, among other components a heater assembly 20, a blower assembly 30, contained within a housing 12.

A switch 14 is included on the outside of the housing 12, the closure of which causes electric current to flow from a power supply (40*a*, 40*b* or 40*c* of FIGS. 6A, 6B and 6C) to electrically connected components in the blower assembly 30 and, if desired, the heater assembly 20, via wires (not shown in FIG. 1). Alternately, a switch 15 can be provided, in addition to switch 14, to selectively, electrically connect the heater assembly 20 to a power supply.

Switch 14 can be of any desired type. However, in one particular preferred embodiment of the invention, the switch 14 is a three-position slide switch, wherein a first position causes a fan of the blower assembly 30 to be operated at a high level, and the second position causes the fan to be operated at a lower level. Moving the switch 14 to the third position would open the circuit and remove power from the blower assembly 30 and, if combined therewith, the heater assembly 20, thus turning off the dryer 10.

Alternately, a switch 15 can be included to permit selective connection of the heater assembly 20 to the power supply. As such, with the switch 15 in an off position, the heater assembly 20 is turned off and operation of the switch 14 permits cool air to be blown from the dryer 10. In the on position, switch 15 permits current to be provided to the heater assembly 20, thus producing heated air at the exit of the dryer 10. The operation of switches 14 and 15 can cause operation of the dryer 10 in the same manner as disclosed in U.S. Pat. No. 5,507,103, that patent being incorporated herein by reference in its entirety. Note that other switches may be included in the housing 12, as desired. The blower assembly 30 and heater assembly 20 of the dryer 10 of the present embodiment operate using a DC voltage. In one particular embodiment of the present invention, the dryer 10 operates using 18V. As such, the power supply provided with the dryer 10 must provide at its output just such a DC voltage.

Figure 6A:
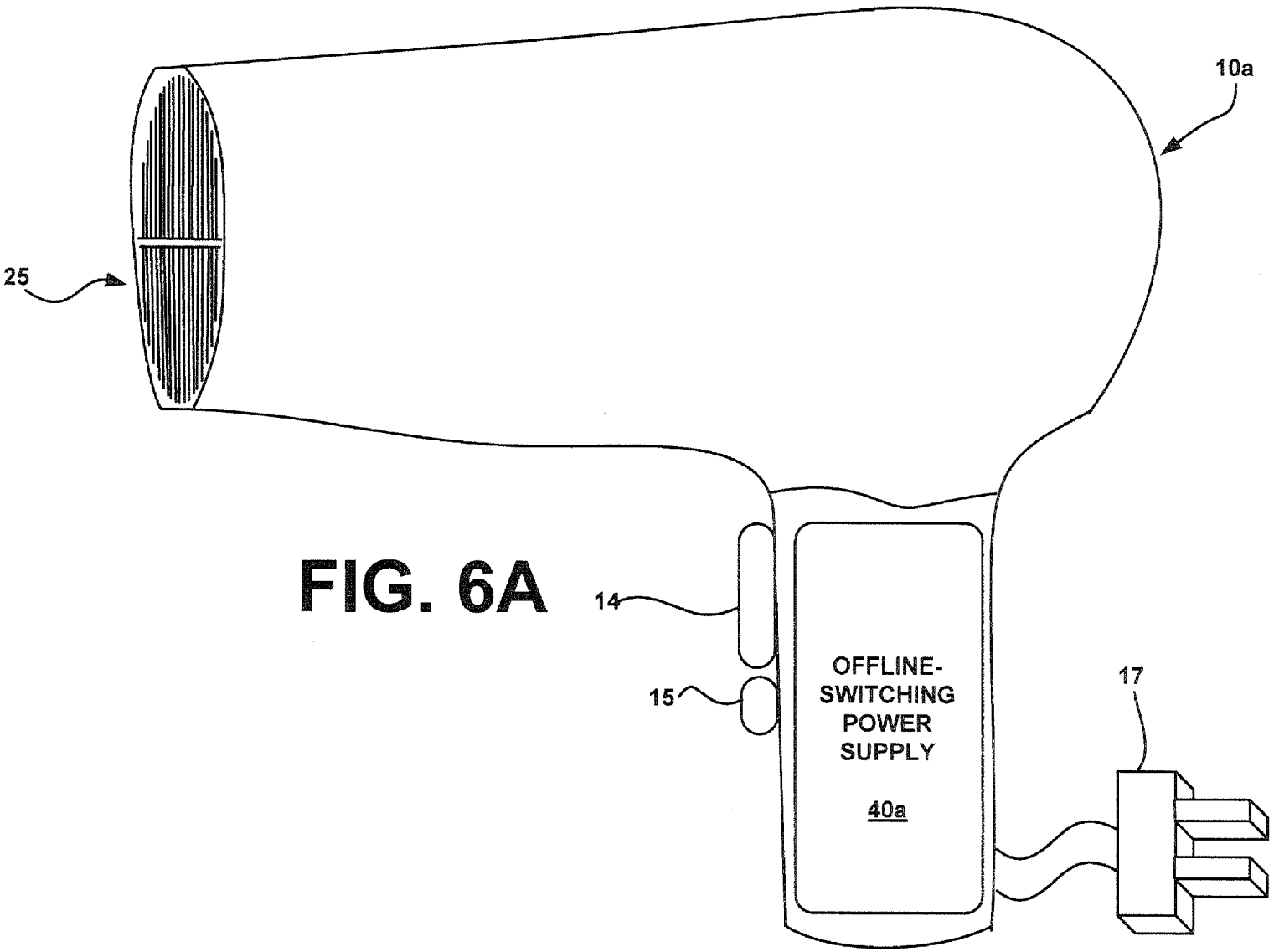
FIG. 6A is a diagrammatic view of a dryer in accordance with one particular embodiment of the present invention, including a power supply therein.
Figure 6B:
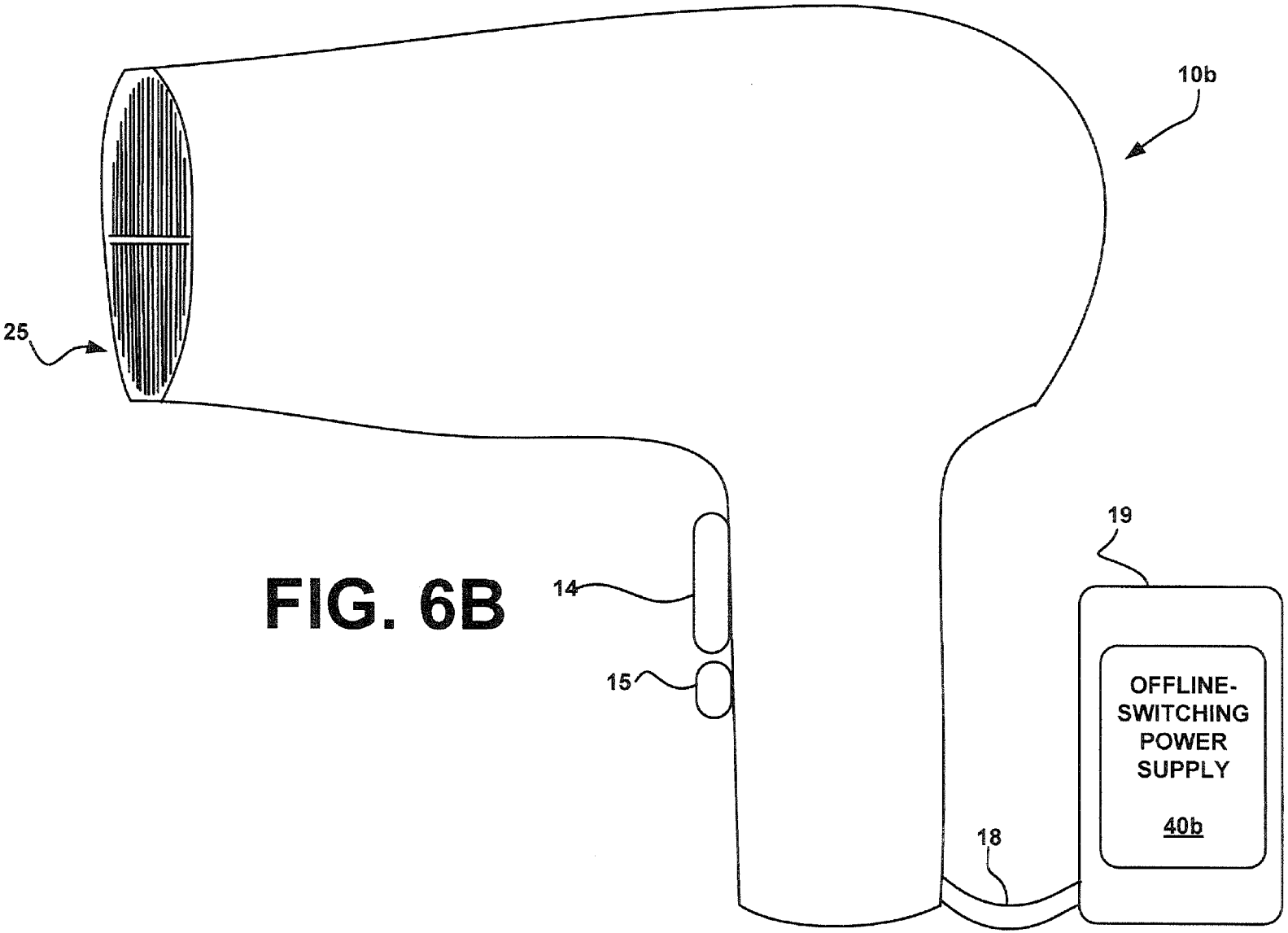
FIG. 6B is a diagrammatic view of a dryer in accordance with another particular embodiment of the present invention, including a power supply external thereto.
Figure 6C:
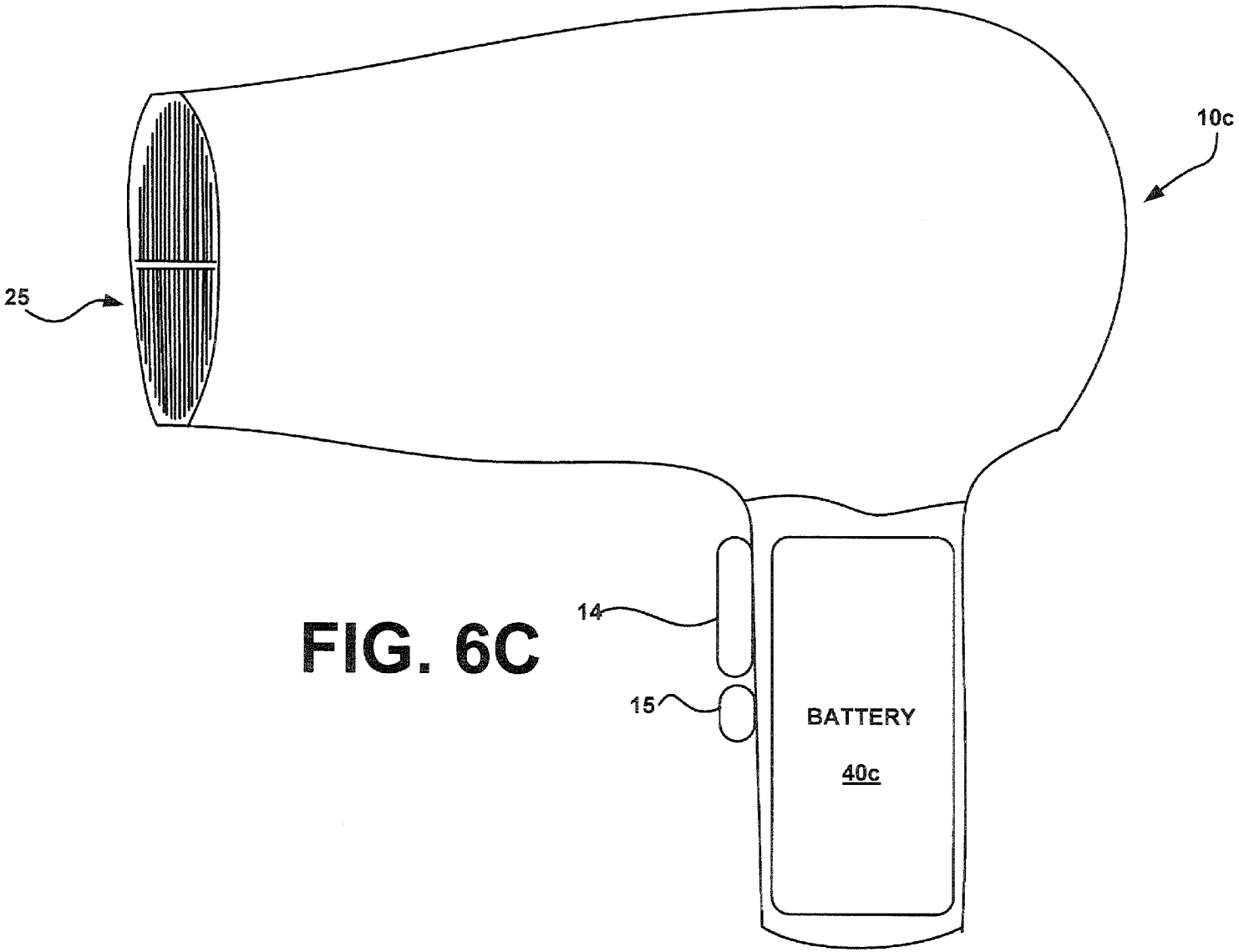
FIG. 6C is a diagrammatic view of a dryer in accordance with one particular embodiment of the present invention, including a battery as the power supply therein.

Referring now to FIGS. 6A-6C, there is shown a dryer in accordance with the present invention (such as the dryer 10 of FIG. 1), powered by a variety of different power supplies 40*a*, 40*b*, 40*c* capable of providing a DC voltage. More particularly, FIG. 6A shows a dryer 10*a*, including a power supply 40*a*, located therein. The power supply 40*a* of the present embodiment is chosen to be an off-line switch mode power supply ("Off-Line SMPS"), which produces a low voltage isolated output from a main source. In the embodiment of FIG. 1, the main source would be the common input from a household supply (i.e., 110V, 120V, 220V, 240V etc.), provided to the power supply 40*a* via the plug 17. Alternately, other power supplies that convert a common household voltage to a DC voltage can be used.

FIG. 6B shows an alternate embodiment of the dryer 10, wherein the power supply 40*b* is external to the dryer 10*b*. For example, the power supply can be incorporated into a separate, external unit 19 that hangs on the wall or sits on a counter, which unit provides a low voltage DC output to the dryer 10*b* via the conductors 18. Note that the dryer 10*b* can be made to be very light in weight, as the power supply is not part of the handheld unit. Additionally, the dryer 10*b* is very safe, since all electronics housed in the handheld unit are low power electronics. Thus, accidental immersion of the dryer 10*b* in water does not pose the same risks as with immersion of a 120V AC dryer. Additionally, the unit 19 can be sized and adapted to receive and hold the dryer 10*b*, when not in use.

In another specific embodiment of the present invention, the power supply of the dryer 10 can be a battery 40*c*, as with the dryer 10*c* of FIG. 6C. The battery 40*c* can be replaceable or, in a more preferred embodiment, can be rechargeable. Additionally, the battery 40*c* can be installed within the handle or any other appropriate area. This will render the device "cordless" and extremely portable as a result of the low power consumption of the device. Batteries constructed of lithium, nickel cadmium, or nickel metal hydride are all suitable and of sufficient energy density to be accommodated within the device. With new battery technology emerging, it is possible to form rechargeable lithium poly batteries into any shape or form thereby allowing the housing itself to serve as a power supply for the device. This is entirely feasible inasmuch as these batteries demonstrate energy to weight ratios of approximately 20 times that of comparable size nickel cadmium or nickel hydride batteries. As such, in contrast to FIG. 6C, which shows the battery 40*c* within a handle portion of the dryer 10*c*, it is to be understood that battery 23 can be formed in any shape, including the shape of a portion of the housing 12, wherein battery 40*c* is not a separate part. As with the earlier embodiment, the dryer 10*c* operates on low voltage and low amperage, thereby reducing and/or eliminating the dangerous electrical shock hazard currently existing in conventional electric hair drying apparatus.

Figure 2A:
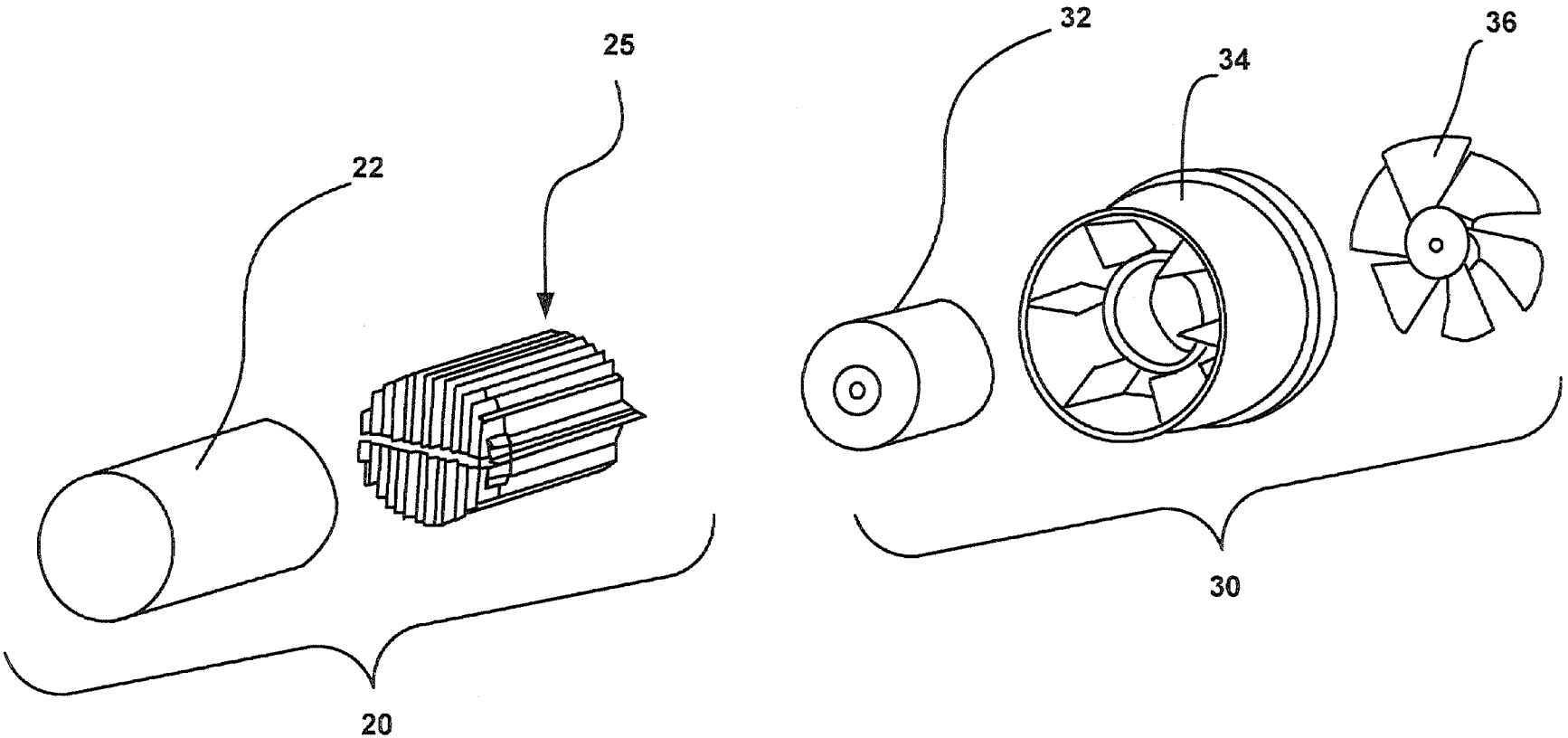
FIGS. 2A and 2B are partially exploded, perspective views of the heater and blower assemblies of a low power hair dryer in accordance with one particular embodiment of the present invention.
Figure 2B:
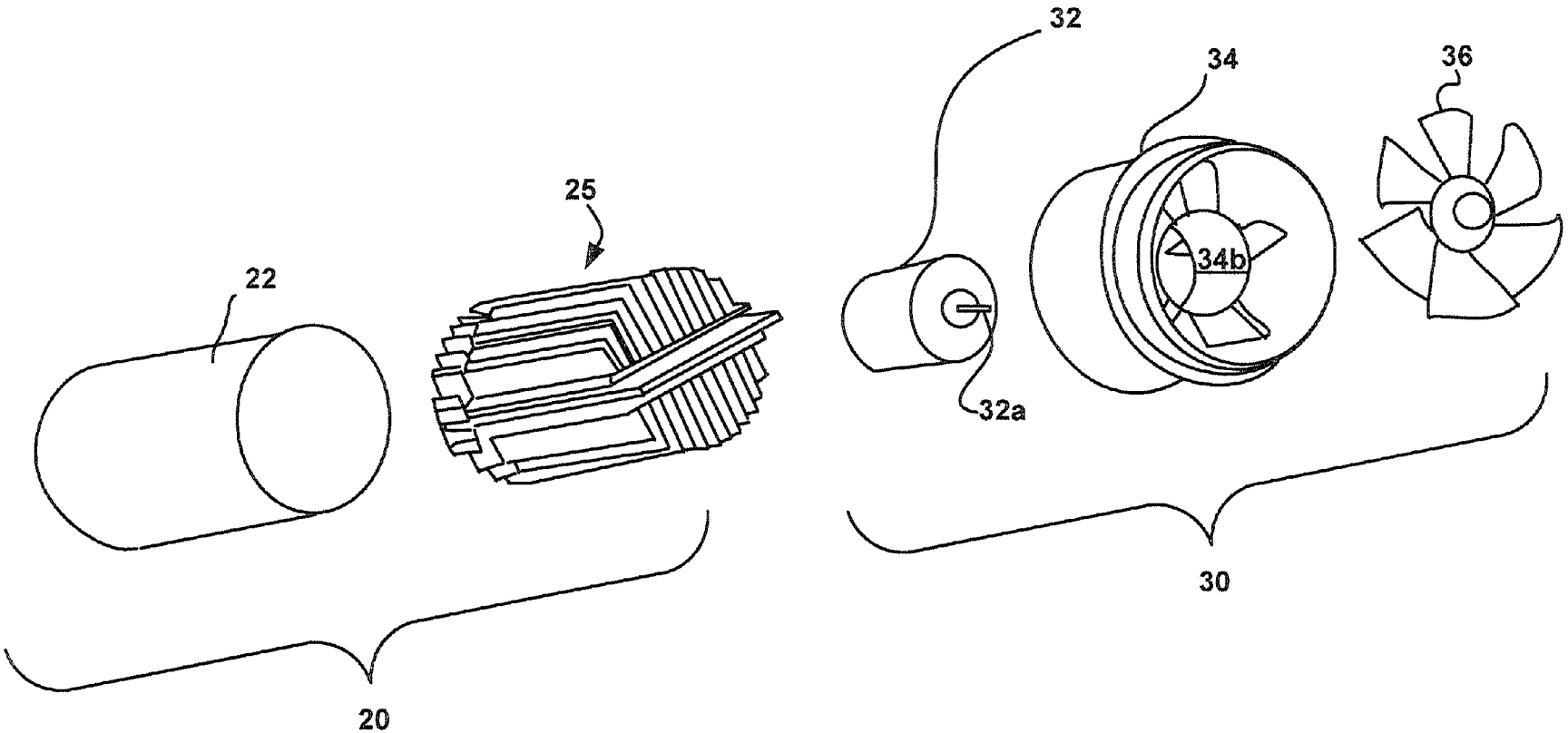
Figure 7:
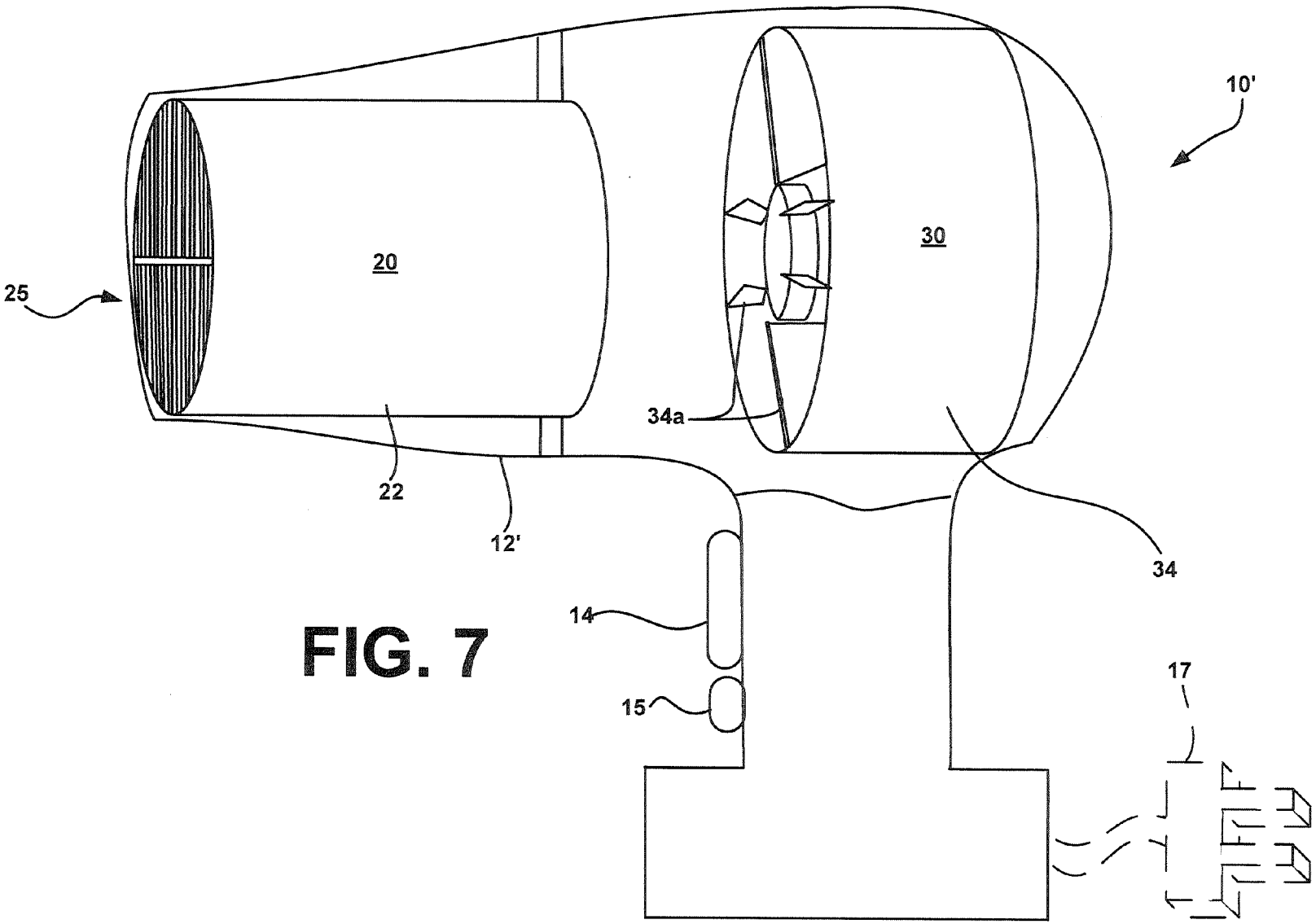
FIG. 7 is a perspective partial cutaway view of a low power hair dryer in accordance with another particular embodiment of the present invention.

The low power dryer 10 of the present invention will now be described in connection with FIGS. 1-2B. More particularly, as described above, the dryer 10 includes a blower assembly 30 and a heater assembly 20, mounted in a housing 12 and powered by a power supply, which power supply can be one of the power supplies described in connection with FIGS. 6A-6C, or may be another type of power supply, as desired. Additionally, the housing 12 can be arranged in other shapes and/or designs from that shown in FIGS. 1 and 6A-6C. For example, FIG. 7 shows an alternate embodiment of a dryer 10', in accordance with the present invention, which includes a blower assembly 30 and a heater assembly 20, mounted in a housing 12' and powered by a power supply, which power supply can be any one of the power supplies described in connection with FIGS. 6A-6C, or may be another type of power supply, as desired. The housing 12' of the dryer 10' of FIG. 7 includes a flanged portion that permits the unit to stand on a flat surface, such as a countertop, as well as providing other advantages.

Referring back to FIGS. 1-2B, the blower assembly 30 includes a fan 36 driven by a motor 32. A drive shaft 32*a* of the motor 32 is interconnected with the fan 36 through a fan housing 34, which engages and supports the motor in a central lumen 34*b*. The fan housing 34 includes additionally includes baffles or stators 34*a*, formed around the central lumen 34*b*, which help control the airflow through the fan housing 34. The motor 32 is electrically connected to the power supply by the switch 14.

When switch 14 is closed, electric current causes the shaft 32*a* of the motor 32 and the fan 36 to rotate, thereby causing air to be drawn into the housing 12 through an air input 16 and creating an airstream of substantial velocity that is forced through the fan housing 34 and the heater assembly 20. If it is desired that a portion of the airstream should additionally flow around the outside of the heater assembly 20, two channels can be formed through the housing 12, as is disclosed in connection with the channels 17 and 18 of U.S. Pat. No. 5,507,103, previously incorporated herein by reference. However, in the preferred embodiment of FIG. 1, the entire airstream from the fan assembly 30 is forced through the heater assembly 20, and more particularly, through channels formed through the thermoelectric heater device 25. The thermoelectric device 30 is located within the heater assembly shroud 22, which acts as a conduit for the airstream. In the present preferred embodiment, the heater assembly shroud 22 is formed of aluminum.

In the present preferred embodiment, the closure of switch 15 additionally connects certain elements of the thermoelectric heater device 25 to power, thus heating the heater assembly 20. The airstream draws heat from the surfaces of the channels of the heater mechanism 32 and the shroud 22 to provide a heated airstream at the output of the dryer 10. With switch 14 closed and switch 15 open, electric power no longer flows to the heater assembly 20, resulting in ambient temperature air being discharged from the dryer 10.

Referring now to FIGS. 3A-4B, there will now be described one particular embodiment of a thermoelectric heater device 25 for use in a dryer in accordance with the present invention with reference to FIGS. 3A-4B. More particularly, the dryer 10 of the present invention makes use of the maximum heat pumping capacity of two Peltier effect, thermoelectric modules operating at steady-state the thermoelectric module at the DT=0 condition (i.e., DT=the temperature of the hot side Th—the temperature of the cold side Tc). The modules can be operated constantly at this performance level with no adverse consequences, as long as the heat produced is rejected at a substantial rate.

Figure 3A:
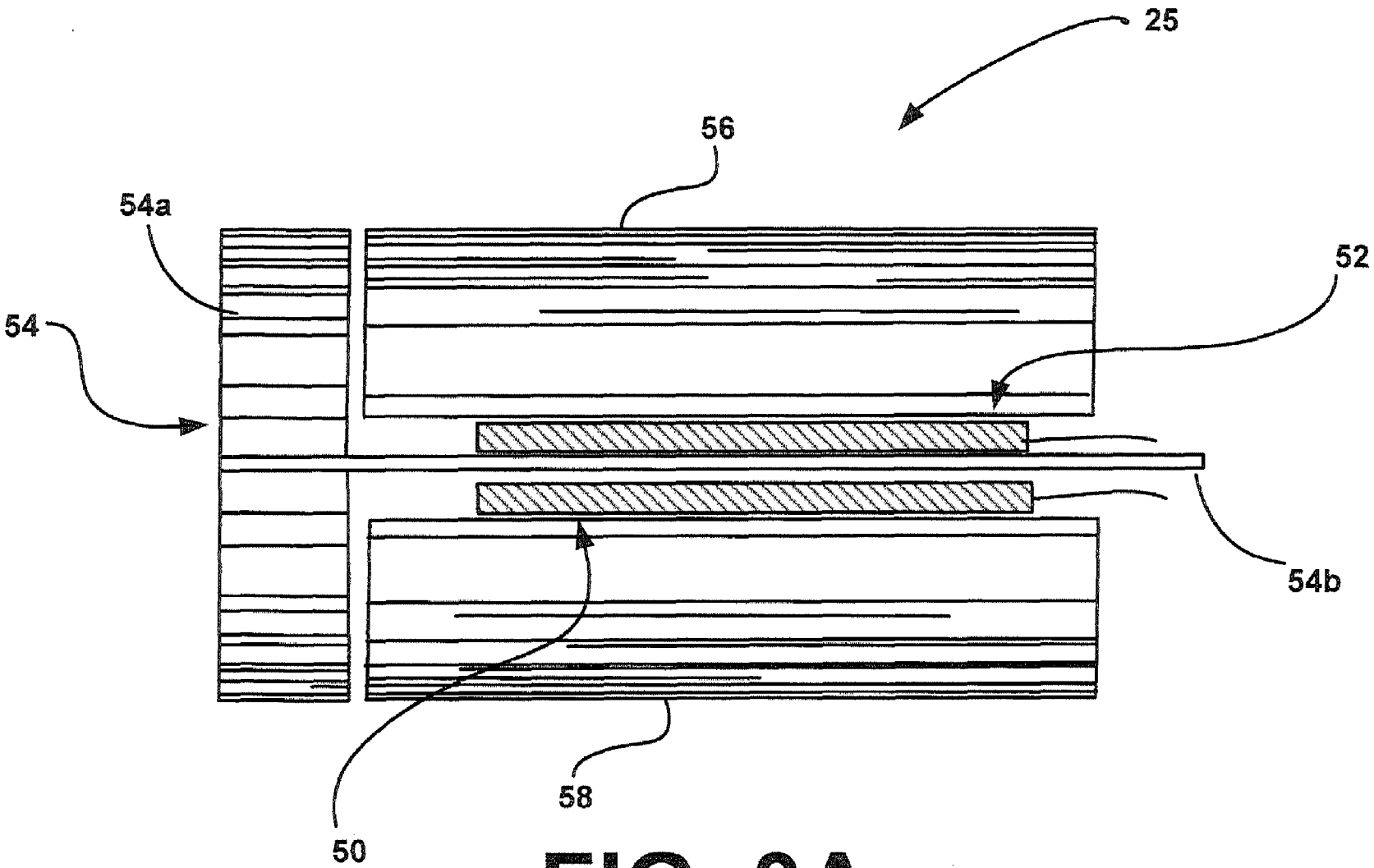
FIG. 3A is a side plan view of one particular embodiment of a thermoelectric heater device for use with a low power hair dryer of the present invention.
Figure 3B:
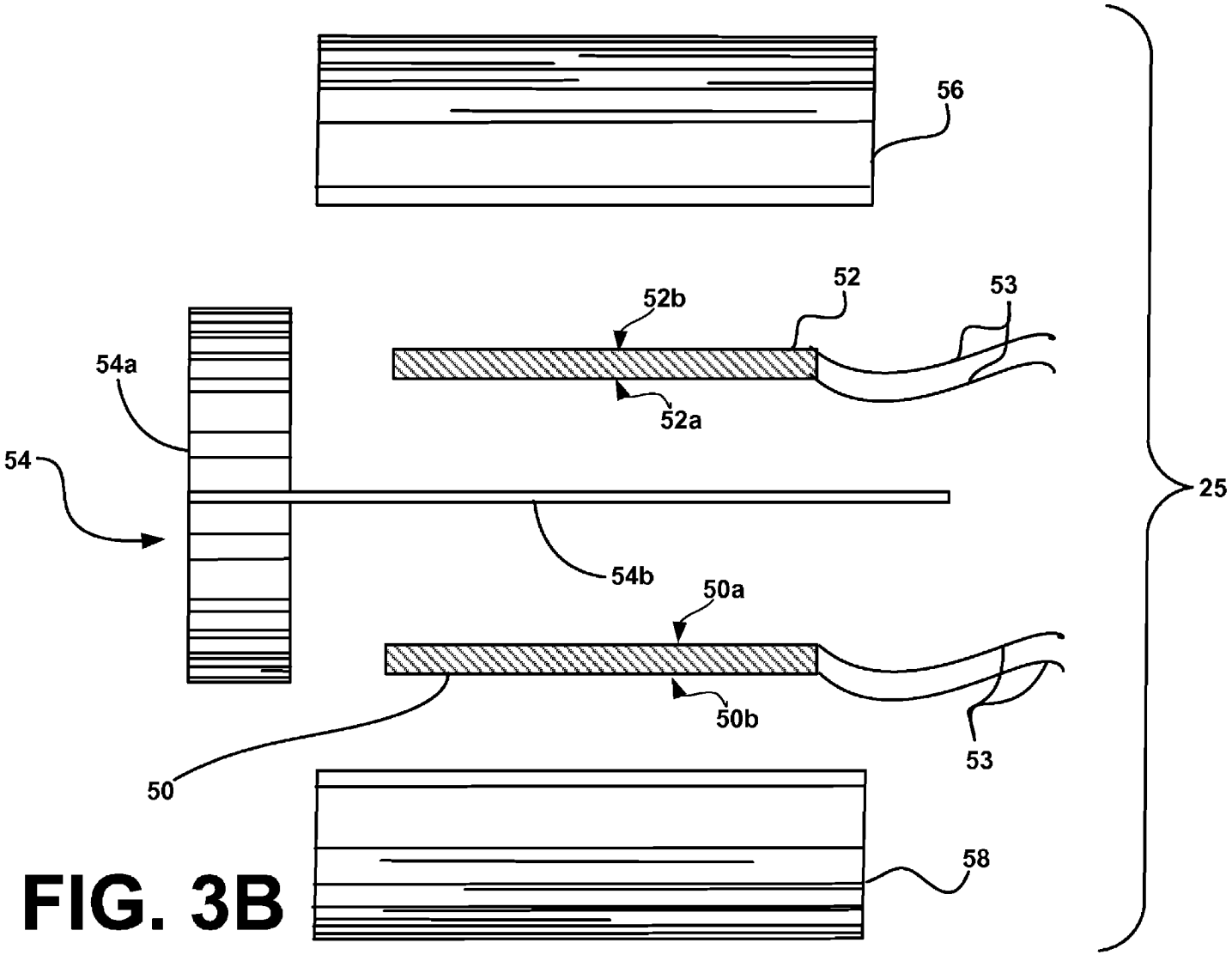
FIG. 3B is an exploded view of the thermoelectric heater device of FIG. 3A.
Figure 4A:
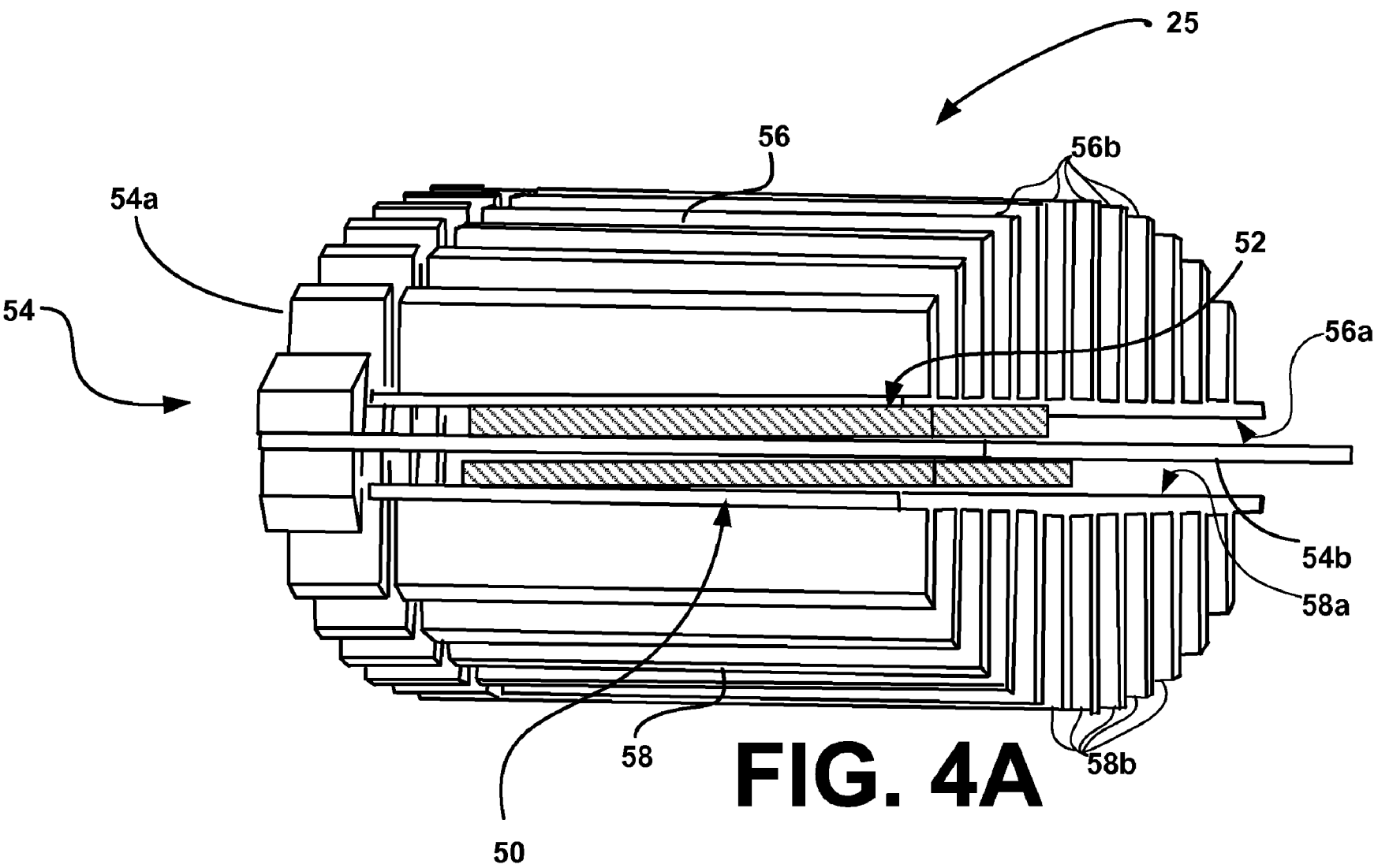
FIG. 4A is a perspective view, taken from the rear, of one particular embodiment of a thermoelectric heater device for use with a low power hair dryer of the present invention.
Figure 4B:
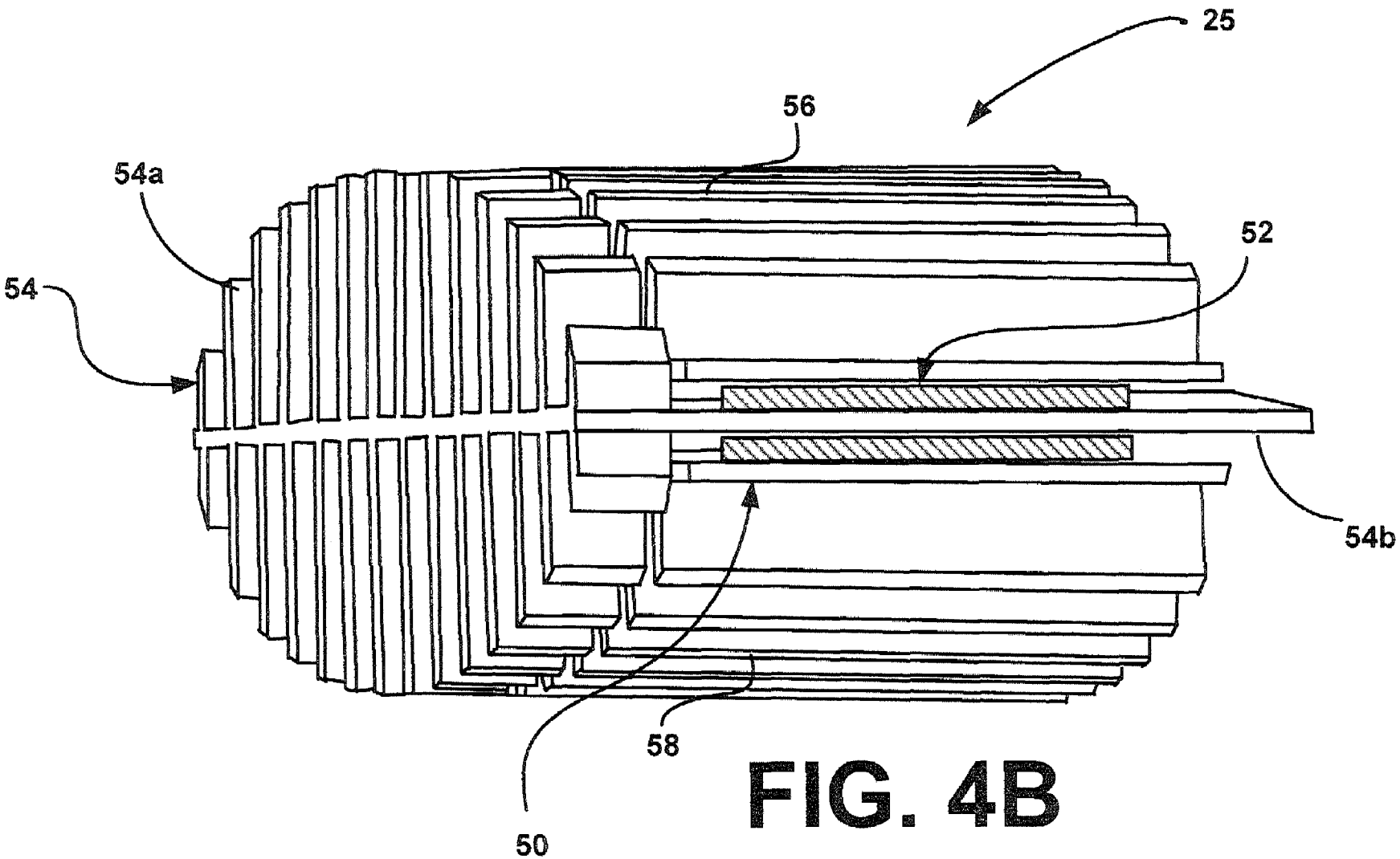
FIG. 4B is a perspective view, taken from the front, of the thermoelectric heater device of FIG. 4A.

As shown more particularly in FIGS. 3A and 3B, the thermoelectric heater device 25 includes a first, central heat sink bar 54*b*, located between two Peltier effect thermoelectric modules 50 and 52. Each of the thermoelectric modules 50, 52 are arranged with its cold side 50*a*, 52*a* adjacent to or, more preferably, in contact with, one of the two opposing major planar faces of the central heat sink 54*b*. The hot side 50*b*, 52*b* of each thermoelectric module 50, 52 is located adjacent to or, more preferably, in contact with, the respective upper or lower heat sink 56, 58. In one particular preferred embodiment, the hot side 50*b*, 52*b* of each thermoelectric module 50, 52 is in contact with a planar base surface 56*a*, 58*a* of the upper and lower heat sinks 56 and 58. Each of the upper heat sink 56 and lower heat sink 58 are provided with a plurality of heat sink fins 56*b*, 58*b*, which are mounted to, and extend perpendicularly from, the planar base surfaces 56*a*, 58*a*. Additionally, each of the upper and lower heat sinks 56, 58 has a semi-circular profile, so that, when assembled the entire thermoelectric heater device 20 will be contained within the cylindrical shroud 22, while maximizing the amount of surface area with which the airstream has contact. Additionally, the number of fins on each of the upper and lower heat sinks 56, 58, can be additionally chosen to maximize both the surface area of, and the air velocity through, the heat sinks 56, 58.

In one preferred embodiment of the present invention, the upper and lower heat sinks 56, 58 are extrusions formed from a thermally conductive material, such as aluminum or copper. In a more preferred embodiment, the upper and lower heat sinks 56, 58 are extruded using aluminum. Alternately, if desired, the upper and lower heat sinks 56, 58 can be of another material having a low thermal resistance, such as DUOCEL® Aluminum Metal Foam made by the ERG Materials and Aerospace Corporation of Oakland Calif. DUOCEL® Aluminum Metal Foam is a porous structure or open-celled foam consisting of an interconnected network of solid struts, commonly known as blown metal foam. Other suitable materials can be used, as desired.

The central heat sink bar 54*b* can be formed with and/or assembled as part of a larger heat sink unit 54. More particularly, an outer heat sink 54*a* is disposed in thermal communication with one end of the central heat sink bar 54*b*, as shown, for example, in FIG. 3B. The outer heat sink 54*a* provides additional surface air in communication with the central heat sink bar 54*b*, through which the airstream must pass. As with the upper and lower heat sinks 56, 58, in one particular preferred embodiment, the outer heat sink 54*a* is an extrusion formed from a thermally conductive material, like aluminum or copper, and has fins that are perpendicular to a base. In another preferred embodiment, the base from which the fins of the outer heat sink 54*a* are formed is the distal end of the central heat sink bar 54*b*, itself. Additionally, in one particular preferred embodiment shown in FIGS. 4A and 4B, the fins of the upper and lower portions of the outer heat sink 54*a* are the same number as, and are aligned with, the fins of the upper and lower heat sinks 56, 58.

The thermoelectric heater device 25 is assembled, as previously described, with the central heat sink bar 54*b* located between the cold sides of each thermoelectric module 50, 52 and the upper and lower heat sinks 56, 58 each being in contact/thermal communication with a hot side of one of the thermoelectric modules 50, 52. Wires 53 extending from each of the thermoelectric modules 50, 52 provide power to the modules 50, 52, as discussed elsewhere herein. In one preferred embodiment, each thermoelectric module 50, 52 includes a 3 amp Peltier effect thermoelectric module. The use of these 3 amp modules in the present invention can provide an output temperature at the outer face of the outer heat sink 54*a* of between 115 and 120° F., wherein the input air was of ambient temperature. The resultant airstream being output from the dryer 10 is, resultantly, not hot enough to burn hair or other articles to which the airstream is applied.

In another preferred embodiment, each thermoelectric module 50, 52 includes a 4 amp Peltier effect thermoelectric module. It should be noted that providing two 4 amp Peltier effect thermoelectric modules enables a system wherein DT is substantially equal to zero, whereas in a system including a single 8 amp thermoelectric module, it is very difficult to obtain DT=0.

Referring now to FIGS. 1-4B, the operation of a dryer in accordance with one particular embodiment of the invention will be described. When switches 14 and 15 are closed, motor 32 and thermoelectric modules 50 and 52 are energized. Energization of the motor 32 causes rotation of the fan, resulting in air being drawn into the housing 12 through an air input 16 and creating an airstream of substantial velocity that is forced through the fan housing 34 and the heater assembly 20. The thermoelectric module 50 of the heater assembly 20 is in thermal communication with both the central heat sink bar 54*b* (cold side) and the lower heat sink 58 (hot side). Similarly, the thermoelectric module 52 of the heater assembly 20 is in thermal communication with the central heat sink bar 54*b* (cold side) and the upper heat sink 56 (hot side).

Each module 50, 52 will absorb heat on the "cold side" and eject it out the "hot side" to a heat sink. Thus, each of the modules 50, 52 act to "cool" (i.e., absorb heat from) the central heat sink bar 54*b* and "heat" (i.e., pump heat to) its respective upper or lower heat sink 56, 58. Thus, each of the upper heat sink 56 and lower heat sink 58 will attain a temperature substantially higher than ambient by virtue of thermal communication with the hot side of the modules 52 and 50, respectively. The upper and lower heat sinks 56, 58 will warm the airstream passing therethrough. This results in air of relatively high temperature and relatively low humidity, being ejected from the output channels of the outer heat sink 54*a*. This air can be used for drying objects, and in particular, for drying hair.

The airstream flowing through the upper and lower heat sinks 56, 58, dissipates the heat from the upper and lower heat sinks 56, 58 as it passes therethrough. The high velocity at which the airstream passes serves to remove the heat quickly from the upper and lower heat sinks 56, 58, thus preventing the temperature of the hot side of each module from increasing. Similarly, the ambient air drawn in by the blower assembly 30 tends to bring the temperature of the central heat sink bar 54*b* to ambient. This creates a thermal feedback loop through the thermoelectric heater device 25. Thus, at steady state (i.e., some time soon after the dryer 10 is turned on), the DT of the thermoelectric modules is essentially zero. More particularly, at steady state, the temperature of both the cold side and the hot side of each of the modules 50, 52 is essentially 27° C., or ambient temperature.

Figure 5:
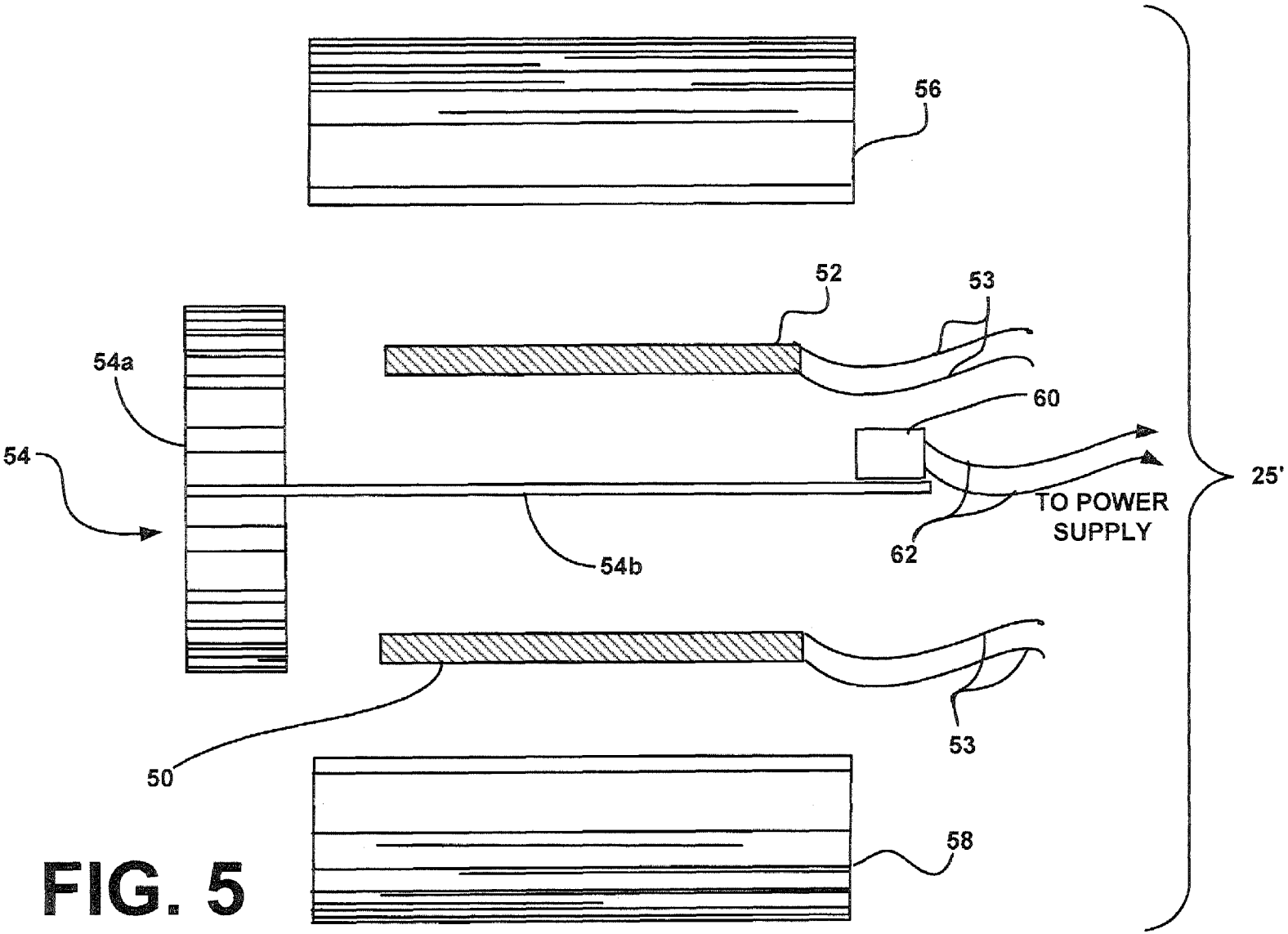
FIG. 5 is an exploded, side plan view of another particular embodiment of a thermoelectric heater device for use with a low power hair dryer of the present invention.

Referring now to FIG. 5, there is shown another embodiment of the present invention a thermoelectric heater device 25' in accordance with the present invention. The thermoelectric heater device 25' can be substituted for the thermoelectric heater device 25 in the dryer 10 of FIGS. 1-4B, and includes all elements of the thermoelectric heater device 25. Like parts bearing like reference numbers will not be described again, herebelow.

Additionally, it is envisioned that the thermoelectric heater device 25' be used with a power supply that converts a common household voltage to a DC voltage, such as is described in connection with FIGS. 6A and 6B, and which includes a clock oscillator and/or a Schottky diode as part of the power supply. In practice, the Schottky diode and clock oscillator used in such power supplies produce a great amount of heat, thus requiring large heat sinks on the power supply circuit board to dissipate the heat generated by these components.

However, the present embodiment of the invention can make use of this heat, by removing one or more of these heat-emitting components, and the heat they emit, from the power supply circuit board. Thus, in addition to the components previously described in connection with the thermoelectric heater device 25, one or more heat-emitting component(s) 60 can be moved from the power supply to the thermoelectric heater device 25'. For example, the thermoelectric heater device 25' can further include the Schottky diode and/or clock oscillator from the power supply (40A of FIG. 6A) mounted on the central heat sink bar 54*b*, as represented by component(s) 60 of FIG. 5. To clarify, this is not an additional Schottky diode and/or clock oscillator, but rather, is the existing Schottky diode and/or clock oscillator of the power supply that is moved off of the power supply board and onto the central heat sink bar 54*b*. Wires 62 electrically connect the heat emitting component(s) 60 back into the remainder of the power supply circuit.

As such, as the power supply operates to convert AC to DC, the heat-emitting component(s) 60 provides additional (higher than ambient) heat to the central heat sink bar 54*b* in thermal communication with each of the cold sides of the thermoelectric modules 50, 52. This added heat is absorbed from the "cold" side and ejected from the "hot" side of each of the modules 50, 52. As with the previous embodiment, the high velocity airstream passing through the upper and lower heat sinks 56, 58 will act to remove the heat from the upper and lower heat sinks 56, 58. This cycle will create a thermal feedback loop, as described above, operating with a temperature differential between its hot and cold faces of essentially zero (i.e., DT is essentially zero). However, with the addition of the heat to the system from the heat-emitting component(s) 60, the temperature of the hot and cold faces of the thermoelectric modules 50, 52 will be much higher than ambient temperature. For example, in one particular embodiment, each of the hot and cold faces of the thermoelectric modules 50, 52 are essentially 50° C., instead of at ambient temperature. This temperature increase would additionally increase the temperature of the air being ejected from the channels of the outer heat sink 54.

Additionally, moving one or both of the clock oscillator and Schottky diode from the power supply circuit board to the central heat sink bar 54*b*, reduces or eliminates the need for one or more large heat sinks on the circuit board of the power supply. This permits the size of the power supply to be greatly reduced, thereby increasing the possibility of bringing the entire power supply into the handheld portion of the dryer, if desired.

The foregoing describes particular embodiments of a handheld dryer in accordance with the present invention, which operates having low power consumption and utilizes Peltier thermoelectric heating modules operating at essentially a zero temperature differential between their hot and cold faces.

Accordingly, while a preferred embodiment of the present invention is shown and described herein, it will be understood that the invention may be embodied otherwise than as herein specifically illustrated or described, and that within the embodiments certain changes in the detail and construction, as well as the arrangement of the parts, may be made without departing from the principles of the present invention as defined by the appended claims.

I claim:

1. A handheld dryer, comprising:

a housing having an air inlet and an air outlet;

a fan, contained within said housing, proximal to said air inlet;

said fan drawing air in through said air inlet and blowing the air out said air outlet;

a first thermoelectric module having a hot side and a cold side, said first thermoelectric module being located in said housing between said fan and said air outlet;

a second thermoelectric module having a hot side and a cold side, said second thermoelectric module also being located in said housing between said fan and said air outlet;

a heat sink unit including a heat sink bar and an outer heat sink;

said outer heat sink being disposed proximal to said air outlet and including a plurality of channels to permit air blown by the fan to pass through said outer heat sink to said outlet;

said heat sink bar being in thermal communication with said outer heat sink, said heat sink bar including first and second opposing faces, the cold side of the first thermoelectric module being disposed in thermal communication with said first opposing face and the cold side of the second thermoelectric module being disposed in thermal communication with said second opposing face, such that said heat sink bar is disposed between the cold face of each of the first and second thermoelectric modules; and a power supply for powering said fan, said first thermoelectric module and said second thermoelectric module.

2. The handheld dryer of claim 1, wherein said power supply converts AC power to DC power.

3. The handheld dryer of claim 2, wherein said power supply is located outside said housing and provides said DC power to the handheld dryer using conductors connected between said power supply and said housing.

4. The handheld dryer of claim 2, wherein said power supply is located within said housing and said AC power is received from outside said housing.

5. The handheld dryer of claim 1, wherein said power supply includes a battery located within said housing.

6. The handheld dryer of claim 1, wherein the cold side of said first thermoelectric module in said housing substantially in parallel with the cold side of said second thermoelectric module.

7. The handheld dryer of claim 6, further including a first heat sink in thermal communication with the hot side of said first thermoelectric module, said fan blowing the air over said first heat sink and out the air outlet.

8. The handheld dryer of claim 7, further including a second heat sink in thermal communication with the hot side of said second thermoelectric module, said fan additionally blowing the air over said second heat sink and out the air outlet.

9. The handheld dryer of claim 1, wherein said power supply includes at least one heat-emitting component in thermal communication with said central heat sink.

10. The handheld dryer of claim 9, wherein said at least one heat-emitting component is mounted to said central heat sink.

11. The handheld dryer of claim 9, wherein said at least one heat-emitting component includes the Schottky diode of the power supply.

12. The handheld dryer of claim 11, wherein said at least one heat-emitting component includes the clock oscillator of the power supply.

13. The handheld dryer of claim 9, wherein said at least one heat-emitting component includes the clock oscillator of the power supply.

14. A hair dryer, comprising:

a housing having an air inlet and an air outlet;

a fan, contained within said housing, proximal to said air inlet;

said fan drawing air in through said air inlet and blowing the air out said air outlet;

a first thermoelectric device located in said housing between said fan and said air outlet, said first thermoelectric device including a first thermoelectric module having a hot side and a cold side and a first heat sink in thermal communication with the hot side of said first thermoelectric device;

a second thermoelectric device located in said housing between said fan and said air outlet, said second thermoelectric device including a second thermoelectric module having a hot side and a cold side and a second heat sink in thermal communication with the hot side of said second thermoelectric device;

a heat sink unit including a heat sink bar and an outer heat sink;

said outer heat sink being disposed proximal to said air outlet and including a plurality of channels to permit air blown by the fan to pass through said outer heat sink to said outlet;

said heat sink bar being in thermal communication with said outer heat sink, said heat sink bar including first and second opposing faces, the cold side of the first thermoelectric module being disposed in thermal communication with said first opposing face and the cold side of the second thermoelectric module being disposed in thermal communication with said second opposing face, such that said heat sink bar is disposed between the cold face of each of the first and second thermoelectric modules; and a power supply for powering said fan, said first thermoelectric module and said second thermoelectric module.

15. The hair dryer of claim 14, wherein each of said first heat sink and said second heat sink has a low thermal resistance and includes a plurality of channels therethrough.

16. The hair dryer of claim 14, wherein said power supply provides DC power to said fan, said first thermoelectric module and said second thermoelectric module.

17. The hair dryer of claim 16, wherein said power supply includes a battery located within said housing.

18. The hair dryer of claim 16, wherein said power supply converts AC power to DC power.

19. The hair dryer of claim 18, wherein said power supply is located outside said housing and provides said DC power to the handheld dryer using conductors connected between said power supply and said housing.

20. The hair dryer of claim 18, wherein said power supply is located within said housing and said AC power is received from outside said housing.

21. The hair dryer of claim 14, wherein said power supply includes at least one heat-emitting component in thermal communication with said central heat sink.

22. The hair dryer of claim 21, wherein said at least one heat-emitting component is mounted to said central heat sink.

23. The hair dryer of claim 21, wherein said at least one heat-emitting component includes the Schottky diode of the power supply.

24. The hair dryer of claim 23, wherein said at least one heat-emitting component includes the clock oscillator of the power supply.

25. The hair dryer of claim 21, wherein said at least one heat-emitting component includes the clock oscillator of the power supply.

26. A method of making a handheld dryer, comprising the steps of:

providing a housing having an air inlet and an air outlet;

providing a fan in said housing, proximal to said air inlet;

assembling a heater device by:

providing a heat sink unit including an outer heat sink and a central heat sink bar in thermal communication with the outer heat sink, the outer heat sink being disposed proximal to the air outlet and including channels to permit air blown by the fan to blow through the outer heat sink to the air outlet;

placing the cold side of a first thermoelectric module in thermal communication with a first planar face of the central heat sink bar;

placing the cold side of a second thermoelectric module in thermal communication with a second, opposing, planar face of the central heat sink bar, such that the central heat sink bar is disposed between the cold faces of each of the first and second thermoelectric modules;

locating a first heat sink in thermal communication with the hot side of the first thermoelectric module; and locating a second heat sink in thermal communication with the hot side of the second thermoelectric module;

locating the assembled heater device in the housing between the fan and the air outlet; and providing a power supply for powering the fan, said first thermoelectric module and the second thermoelectric module.

27. The method of claim 26, wherein said power supply includes at least one heat-emitting component in thermal communication with said central heat sink bar.

28. The method of claim 27, wherein said at least one heat-emitting component is at least one of the Schottky diode of the power supply and the clock oscillator of the power supply.

29. The method of claim 26, wherein said at least one heat-emitting component is mounted to said central heat sink bar.

* * * * *